US005094610A

United States Patent [19]

Mandai et al.

[11] Patent Number: 5,094,610

[45] Date of Patent: Mar. 10, 1992

[54] BURNER APPARATUS

[75] Inventors: Shigemi Mandai; Nobuo Satoh; Ichiro Fukue; Satoshi Tanimura, all of Takasago, Japan

[73] Assignee: Mitsubishi Jukogyo Kabushiki Kaisha, Tokyo, Japan

[21] Appl. No.: 522,185

[22] Filed: May 11, 1990

[30] Foreign Application Priority Data

May 11, 1989 [JP] Japan ..... 1-53405

[51] Int. Cl.[5] ..... F23C 5/08; F23C 1/00

[52] U.S. Cl. ..... 431/183; 431/8; 431/181; 431/187; 431/284; 431/278; 110/262; 110/264; 239/400; 239/404

[58] Field of Search ..... 431/8, 9, 10, 2, 181, 431/182, 183, 184, 185, 159, 278, 283, 284, 285, 174, 350, 353; 60/39.01, 39.36, 722, 39.826; 239/400, 403, 404, 405; 110/262, 264

[56] References Cited

U.S. PATENT DOCUMENTS 1,508,718 9/1924 Peabody ..... 431/183 X
1,954,873 4/1934 Gwathmey ..... 239/404
2,755,750 7/1956 Escher ..... 431/183 X
4,374,466 2/1983 Sothean ..... 60/39.36

FOREIGN PATENT DOCUMENTS 363452 11/1922 Fed. Rep. of Germany ..... 239/404
2724532 12/1978 Fed. Rep. of Germany ..... 431/183
0981759 12/1982 U.S.S.R. ..... 110/262
304079 1/1929 United Kingdom ..... 110/264
704901 3/1954 United Kingdom ..... 110/262

*Primary Examiner*—Carl D. Price
*Attorney, Agent, or Firm*—Toren, McGeady & Associates

[57] ABSTRACT

A burner apparatus which comprises a pilot burner including a nozzle and swirlers disposed around the nozzle, and a plurality of main burners which are arranged around the pilot burner and each of which comprises a nozzle and swirlers disposed around the nozzle; and the angle of the swirlers for the pilot burner is set larger than the angle of the swirlers for the main burner so that the angles of the two types of swirlers cross. NOx production can be considerably reduced with a very simple structure based on the present invention for combustion in boilers and gas turbines.

3 Claims, 3 Drawing Sheets

BURNER APPARATUS

FIELD OF THE INVENTION AND RELATED ART STATEMENT

The present invention relates to an improvement on combustors in boilers and gas turbines.

Conventional burners in combustors, such as boilers, have swirlers 2 for supplying combustion air around a fuel nozzle 1 as shown in FIGS. 5 and 6, and the angle of these swirlers with respect to the axial line 3 is normally set between 30° and 45° so as to maintain stable flame.

A flow pattern of air in these burners is shown in FIG. 7. Against air flow 4, circulatory flow 5 is formed.

With this type of conventional burners, even if lean-burn flame is used the reduction of NOx production is limited, and it has become impossible to respond to strict NOx control requirements which have come to be imposed recently.

In the case of gas turbine combustors, in particular, it has become necessary to reduce the formation of NOx not only at gas burning combustors, but also at oil burning combustors. Conventional burners, however, have been unable to satisfy this necessity. While it has been indispensable to use partial premix flame in order to reduce the formation of NOx, if a premix combustion system is adopted for liquid fuel in the same way as for gas fuel, backfire and self ignition could occur because the ignition temperature of liquid fuel is around 250° C. and the air temperature is around 350° C. A premix combustor system therefore has not been used for oil burning combustors.

OBJECT AND SUMMARY OF THE INVENTION

An object of the present invention is to provide a burner apparatus that is capable of reducing the formation NOx beyond the limit inherent in conventional burners as described above.

In order to accomplish this object, the present invention provides a burner apparatus comprising: a pilot burner having a nozzle and swirlers disposed around this nozzle for the pilot burner, and a plurality of main burners which are arranged around this pilot burner and each of which has a nozzle and swirlers disposed around the nozzle for the main burner; the angle of the swirlers for the pilot burner is set to be larger than the angle of the swirlers for the main burner so that the angles of these two types of swirlers cross.

According to this burner apparatus, main burners by themselves cannot sustain sufficient circulation flow and stable flame because the angle of the air swirlers around the main burners is smaller than that of the swirlers around the pilot burners. Therefore, fuel supplied from the the main burners mixes with air supplied from the air swirlers around the main burners and flies away.

The fuel and air from the main burners form a premixed gas and start combustion upon contact and mixing with high-temperature gas from the pilot burner, which serves as pilot flame, greatly reducing the generation of NOx.

DETAILED DESCRIPTION OF A PREFERRED EMBODIMENT

We will now describe in detail an embodiment of the burner apparatus of the present invention with reference to FIGS. 1 to 4.

Figure 1:
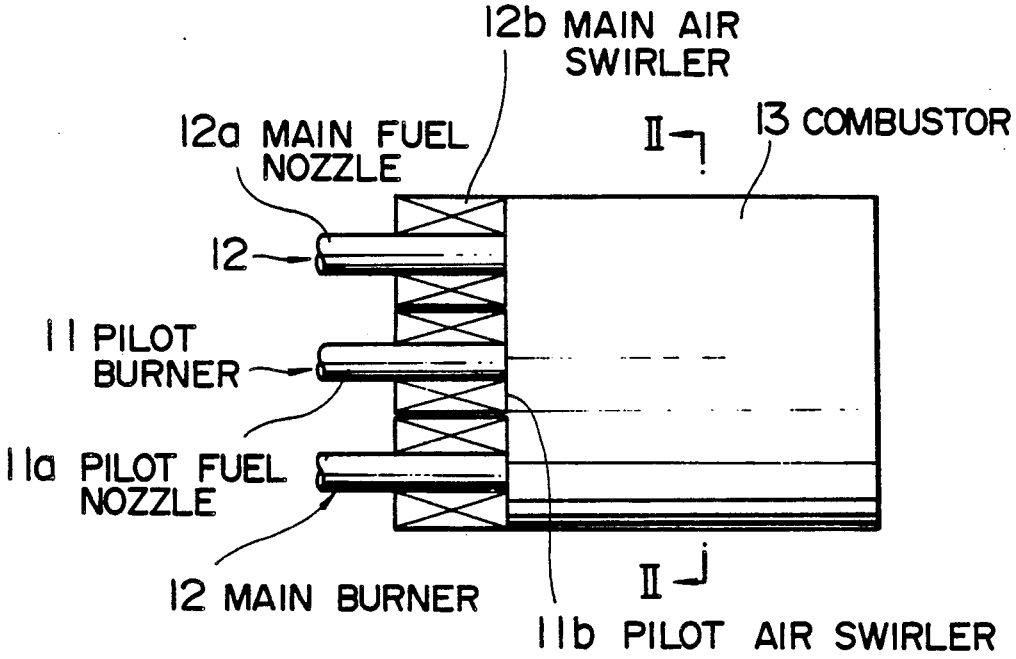
FIG. 1 is a side section view of an embodiment of the burner apparatus of the present invention.
Figure 2:
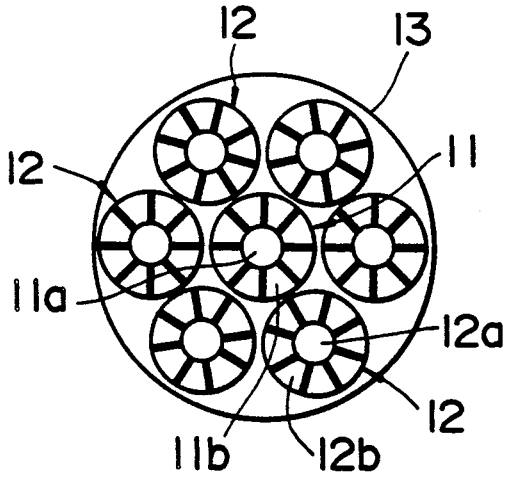
FIG. 2 is a plan view observed from the direction of the arrows II—II in FIG. 1.

FIG. 1 shows a side section view of a combustor with the burner apparatus of the present invention. FIG. 2 is a plan view from the direction of the arrows II—II of FIG. 1.

As shown in these drawings, the burner apparatus of the present invention comprises a pilot burner 11 and a plurality of main burners surrounding this pilot burner. The numeral 13 indicates a combustor, and the pilot burner 11 is placed in the center of one end of this combustor. This pilot burner 11 has a pilot fuel nozzle **11*a* in its center and pilot air swirlers 11*b* surrounding the nozzlel 11*a*. Also, the main burners arranged around the pilot burner 11 have a main fuel nozzle 12*a* in their center and main air swirlers 11*b* surrounding the nozzle 12*b***.

Figure 3:
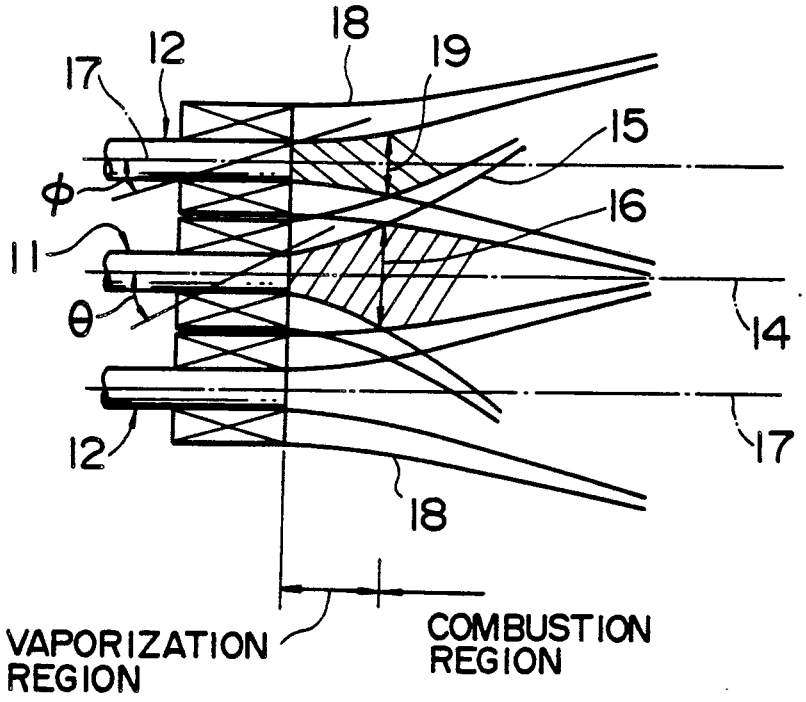
FIG. 3 is a side section view of the burner apparatus for describing the functions of the present invention.

As shown in FIG. 3, the swirler angle $\theta$ of the pilot burner 11 is set between 30° and 45° with respect to an axial line 14 so that swirling flow 15 of the pilot burner air and a circulating flow region 16 necessary for stable flame are formed. On the other hand, the swirler angle $\phi$ of the main burners 12 is set to be less than 20° with respect to the axial line 17 so that the swirling flow 18 of the main burner air and a circulating flow region that is too small for stable flame are formed.

Also, as for the direction of the swirlers, the direction of swirling is different between the swirlers for the pilot burner 11 and the swirlers for the main burner 12, while the swirlers for the main burners 12 are all directed for the same swirling direction.

Figure 4:
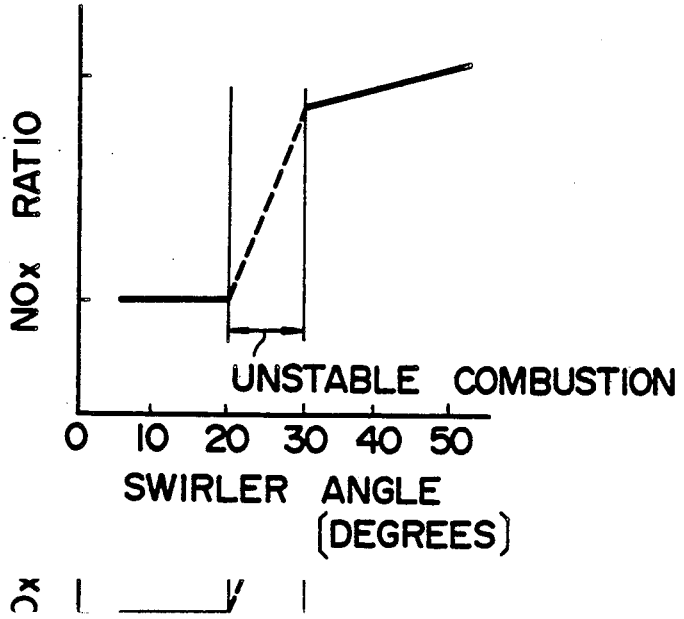
FIG. 4 is a characteristic graph showing the relationship between the swirler angle and a NOx ratio.
Figure 5:
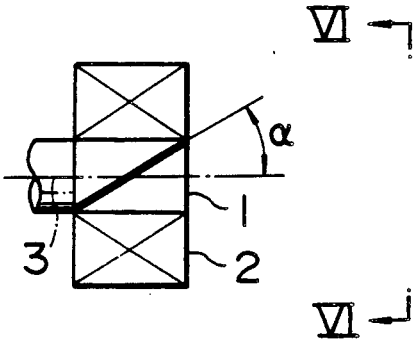
FIG. 5 PRIOR ART
FIG. 5 is a side section view of a conventional burner apparatus.
Figure 6:
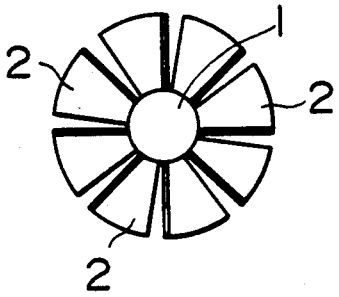
FIG. 6 PRIOR ART
FIG. 6 is a plan view observed from the direction of the arrows VI—VI in FIG. 5.
Figure 7:
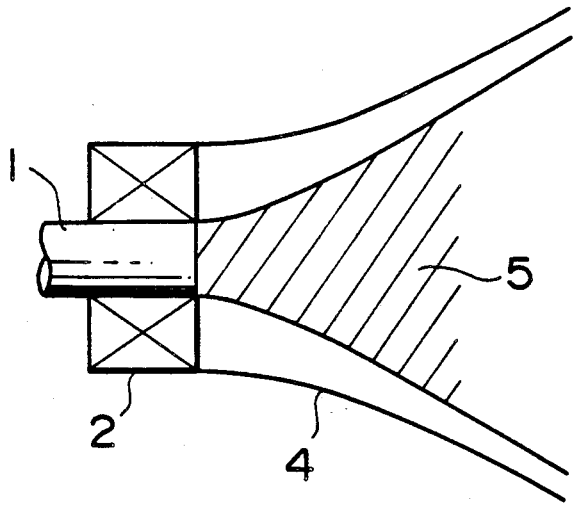
FIG. 7 PRIOR ART
FIG. 7 is a diagram for explaining the operation of the conventional burner apparatus.

As described above, the angle $\theta$ of the swirlers **11*b* for the pilot burner 12 is set larger than the angle $\phi$ of the swirlers for the main burner (that is, $\theta > \phi$) so that the two angles cross each other. This is, as shown in FIG. 4**, because stable combustion can be maintained with a swirler angle larger than 30°, while combustion becomes unstable and very sensitive to boundary conditions with the swirler angle beteween 20° and 30°, and also because when the angle is equal to or less than 20° an NOx ratio can be reduced greatly.

Stated more in detail, because the angle of the swirlers for the main burner 12 is set to be less than 20°, flame becomes unstable and is blown away, and the distance at which the flame is blown away may be used for vaporizing and mixing fuel with the air. The region up to a point where the main burner swirler angle and the pilot burner swirler angle cross each other is used as a vaporization region, and the region downstream from this point is used as a combustion region. Thus, combustion is initiated by the pilot flame in this combustion region so as not only to prevent backfire and self ignition but also to maintain stable combustion and reduce Nox produced.

Also, when gas oil is used, the diameter of gas oil particles is adjusted according to the distance required for fuel droplets to vaporize.

Furthermore, because the direction of the swirlers is opposite for the pilot burners 11 and for the main burner 12, in the region where the flows from the main and pilot burners cross, the direction of these flows is turned to the tangent of the two flows, and the stability of flame can therefore be achieved.

According to the present invention, the following effects can be achieved.

The main burners are designed so that they cannot maintain stable flame. The fuel supplied from the fuel nozzle of the main burners and the air supplied from the swirlers surrounding the main burners are mixed and come into contact with the pilot flame of the pilot burner and burns. Premixed flame is formed with the main burner and is ignited by the pilot burner so that complete combustion is achieved and the production of NOx is reduced.

Also, according to the present invention, since a premixed mixture is produced without using a premixing nozzle, problems inherent in premixed flame, such as flashback and self ignition (autoignition), can be prevented from occurring.

With the burner apparatus of the present invention, NOx production can be reduced when either liquid or gas fuel is used as well as when both of these are used.

As described above in detail, according to the present invention, a burner apparatus having a simple structure can achieve considerable NOx reduction, and its effects in practice are quite significant.

What is claimed:

1. A burner apparatus comprising: an axially elongated tubular combustor, a pilot burner located with said combustor and comprising a first fuel nozzle having a first axis extending in parallel with the combustor axis, said first nozzle having an outside surface, and first air swirlers secured to and twisting around the outside surface of said first fuel nozzle, a plurality of main burners in generally parallel relation with and arranged around the pilot burner within said combustor and each said main burner comprises a second fuel nozzle having a second axis extending in parallel with the first axis and an outside surface, and second air swirlers twisting around the outside surface of the second fuel nozzle; said first and second air swirlers formed as vanes oriented whereby the direction of twisting of the first air swirlers is opposite to the direction of twisting of the second air swirlers so that the air flow about the first fuel nozzle is opposite to the air flow about the second fuel nozzles.

2. A burner apparatus as described in claim 1, wherein the angle of the first air swirlers of the pilot burner is set between 30° and 45° with respect to the first fuel nozzle axis, and the angle of the second air swirlers of the main burners is set to a value less than 20° with respect to the second fuel nozzle axes.

3. A burner apparatus as described in claim 1, wherein the angle of the first air swirlers for the pilot burner relative to the first fuel nozzle axis is set larger than the angle of the first air swirlers for the main burner relative to the second fuel nozzle axes so that the angles of the first and second air swirlers cross.

* * * * *